US007947203B2

(12) United States Patent
Niiranen

(10) Patent No.: US 7,947,203 B2
(45) Date of Patent: May 24, 2011

(54) PROCEDURE AND APPARATUS IN DRY FORMING OF FIBRE LAYER

(75) Inventor: Heikki Niiranen, Hameenlinna (FI)

(73) Assignee: Anpap Oy, Valkeakoski (FI)

( * ) Notice: Subject to any disclaimer, the term of this patent is extended or adjusted under 35 U.S.C. 154(b) by 648 days.

(21) Appl. No.: 10/588,824

(22) PCT Filed: Feb. 11, 2005

(86) PCT No.: PCT/FI2005/000088

§ 371 (c)(1),
(2), (4) Date: Dec. 4, 2008

(87) PCT Pub. No.: WO2005/078193

PCT Pub. Date: Aug. 25, 2005

(65) Prior Publication Data

US 2009/0078385 A1 Mar. 26, 2009

(30) Foreign Application Priority Data

Feb. 12, 2004 (FI) ..... 20040218

(51) Int. Cl.
*B29C 59/00* (2006.01)

(52) U.S. Cl. ..... 264/121; 264/131; 264/518; 162/289; 156/62.2

(58) Field of Classification Search ..... 264/121, 264/113, 518, 510; 19/145.5, 304; 162/289; 156/62.2; 425/81.1, 83.1
See application file for complete search history.

(56) References Cited

U.S. PATENT DOCUMENTS

| | | | | |
|---|---|---|---|---|
| 3,748,693 | A | 7/1973 | Jespersen | |
| 4,761,858 | A | 8/1988 | Maijala | |
| 5,269,049 | A * | 12/1993 | Gustafsson et al. | 19/304 |
| 2003/0010683 | A1 | 1/2003 | Christensen | |
| 2003/0066168 | A1 | 4/2003 | Schneider | |

FOREIGN PATENT DOCUMENTS

| | | | |
|---|---|---|---|
| DE | 362 4470 | A1 | 2/1987 |
| EP | 0 536 904 | A1 | 4/1993 |

* cited by examiner

*Primary Examiner* — Mark Halpern
(74) *Attorney, Agent, or Firm* — Hoffman & Baron, LLP

(57) ABSTRACT

The invention relates to a procedure and an apparatus in dry formation of a fibre layer, in which procedure fibre-containing air is passed through a forming wire (7) moving via a former (2) or an equivalent distributor unit and further through a suction box (8) or equivalent placed below the forming wire, and which air is circulated back to the upper part of the same or another former. In the solution of the invention, the air circulated through the suction box (8) is passed to the upper part of the former via channels (17) with an adjustable flow rate.

10 Claims, 1 Drawing Sheet

PROCEDURE AND APPARATUS IN DRY FORMING OF FIBRE LAYER

Figure 1:
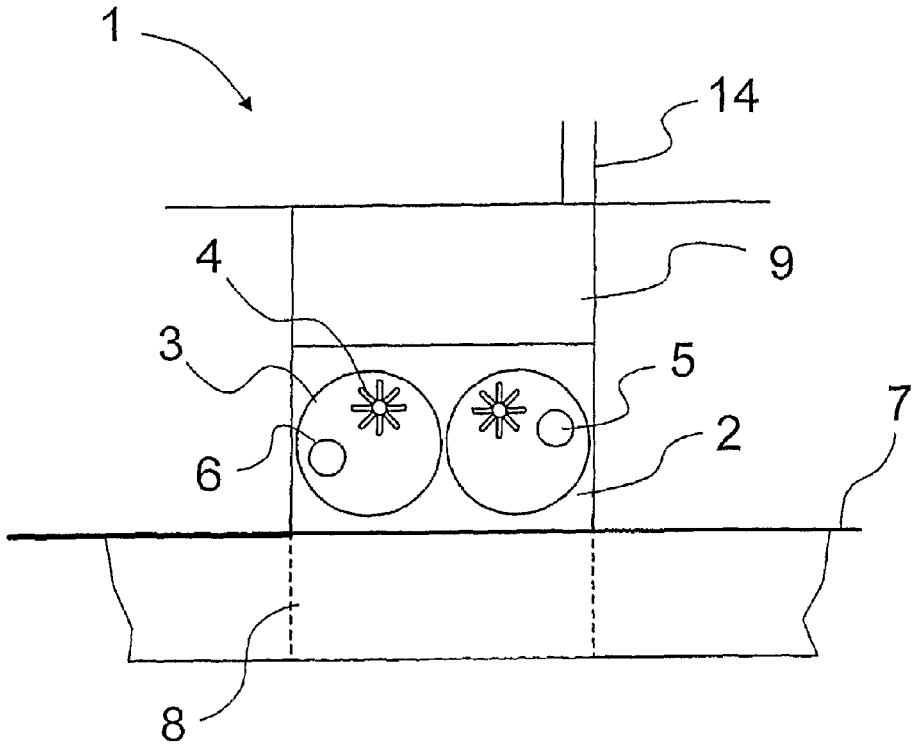

This application is the U.S. National Phase of, and Applicant claims priority from, International Application Number PCT/FI2005/000088 filed 11 Feb. 2005, and Finland Patent Application bearing Serial No. FI 20040218 filed 12 Feb. 2004, all of which are incorporated herein by reference.

BACKGROUND OF THE INVENTION

The present invention relates to a procedure and to an apparatus use in dry forming of a fibre layer.

The procedure and apparatus of the invention, which are hereinafter referred to by the common designation 'solution of the invention', are applicable for use for dry formation of a fibre layer in web material, e.g. in conjunction with paper manufacture. In this type of processes, a fibrous raw material, such as wood pulp, is generally defibrillated before the formation of a fibre layer e.g. in a hammer mill to produce separate fibres, which are passed with a conveying air flow via various devices associated with the process into a distributor unit called a former. The production line may contain several formers like this placed one after the other e.g. to produce several fibre layers. A typical former is e.g. a drum former, which may have one or more cylindrical drums or screen tubes side by side, with apertures or through holes in their cylindrical surface for spreading the fibre flow onto a formation surface on a moving forming wire below the former.

Placed inside the former drum, close to the inner surface of the drum, is generally a consecutive series of bladed wheels or a single elongated bladed wheel, which breaks up any lumps in the fibre flow and distributes the fibre flow as evenly as possible to the through holes in the drum. In a dual-drum former, the fibre flow is conveyed by a conveying air flow blown into the drums to produce a fibre layer as even as possible e.g. from the ends of the drums so that the fibre flow enters the drums from their opposite ends.

Below the former is a moving wire called forming wire, whose upper surface acts as a fibre layer forming surface. Below the wire, aligned with the former is a suction box, which produces a suction that draws fibres from the former to the forming surface.

The function of the former is to distribute the fibres as a layer as even as possible on the forming surface of the wire in order that that the product to be manufactured should be as homogeneous as possible. However, a problem with prior-art dry formation solutions is that the fibre flow cannot be distributed so as to form a sufficiently even layer over the entire width of the forming surface.

To solve the above-mentioned problem, improved versions of the above solutions have been developed. In one such a solution, the fibre flow is spread onto a forming surface by means of a downwards widening discharge conduit. Similarly, a supply conduit is divided into four separate discharge conduits. As the device has no flow adjustment in the supply or discharge conduit, the device requires the use of complex mixers to mix the fibre mass to produce a layer as even as possible on the forming surface of the wire. The drawback is a complicated and failure-prone construction that requires frequent maintenance.

U.S. Pat. No. 4,761,858 also discloses an improved structure for producing from the fibre flow a layer as even as possible on the forming wire. The apparatus is provided with air circulation and an intermediate chamber placed above the drum former and having in its upper and lower parts mutually perpendicular fins for adjustment of the passage of the fibre flow. The adjustment enables a more even formation of the fibre layer, but the problem here is that the adjustment can not be made during operation. Therefore it is not possible to achieve an ideal adjustment and the time required for the adjustment reduces the operating time of the apparatus. Moreover, the adjustment made from the fins is a complicated and difficult operation. An additional disadvantage is that the lattices formed by the fins are tight and are easily blocked, necessitating an interruption of production and cleaning of the lattices.

SUMMARY OF THE INVENTION

The object of the present invention is to overcome the above-mentioned drawbacks and to achieve an effective and reliable former structure that produces a fibre layer as even as possible and makes it possible to attain a good final result and capacity in conjunction with the manufacture of paper or corresponding material.

The solution of the invention has the advantage that the invention enables good, fast and flexible adjustments of fibre flow during operation, thus allowing an even fibre layer to be formed on the forming surface. In addition, the adjustment is effective and operation-time adjustment enables a high capacity as the apparatus need not be stopped to allow adjustments. Moreover, the construction of the apparatus is simple and reliable.

BRIEF DESCRIPTIONS OF THE DRAWINGS

Figure 2:
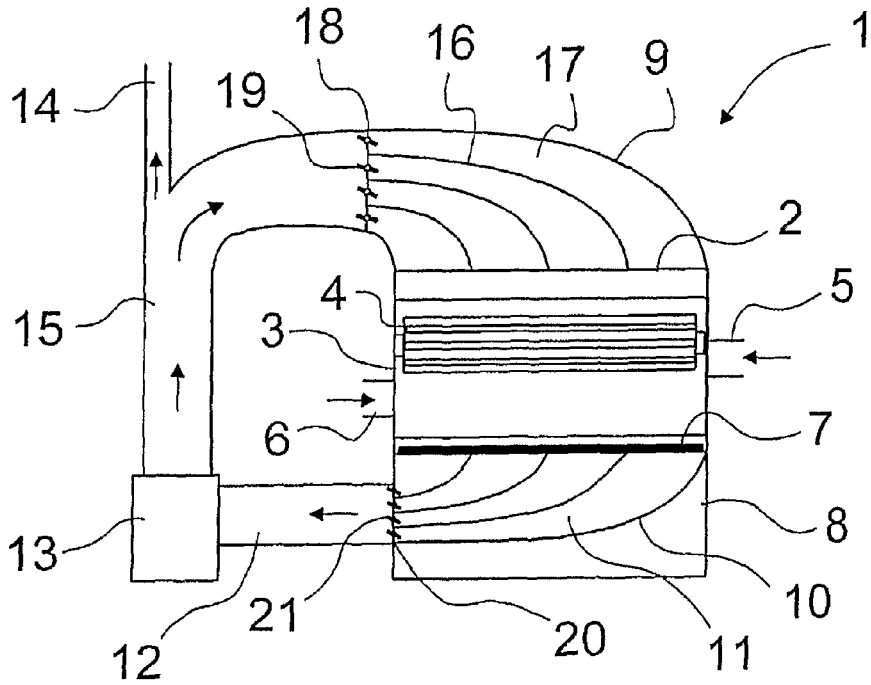

In the following, the invention will be described in detail with reference to an embodiment example and the attached drawings, wherein FIG. 1 presents a diagrammatic and simplified view of a part of a production line, showing one drum former partially sectioned and in side view, and FIG. 2 presents a simplified cross-sectional front view of the part of a production line presented in FIG. 1.

DETAILED DESCRIPTION OF THE INVENTION

FIG. 1 presents a side view of an apparatus 1 implementing the concept of the invention, which in this case comprises a drum former 2 as a distributor unit having two parallel screen drums 3 transverse to the direction of motion of the web to be formed, said drums 3 being placed substantially above the forming surface of a moving forming wire 7. Inside each screen drum 3 is an elongated bladed wheel 4 which is mounted in the axial direction of the screen drum and which breaks up any lumps in the fibre flow and distributes the fibre flow as evenly as possible to through holes provided in the drum shell. The fibre flow is supplied into the screen drums 3 along with a conveying air flow via inlet openings 6 and 6 at opposite ends of the screen drums 3, and in the solution according to FIG. 1 inlet opening 5 is in the front end of a first screen drum and inlet opening 6 is in the back end of a second screen drum.

Placed oppositely to the screen drums 3 below the forming wire 7 is a suction box 8, through which the fibre flow conveying air is drawn by suction through the forming surface of the forming wire 7 to form the fibre layer of the web. Correspondingly, placed above the former part is a set of channels 9 transverse to the direction of motion of the forming wire 7, via which channels the air circulated in the system is passed again to the former 2.

In FIG. 2, the apparatus of the invention is presented in front view, i.e. as seen against the direction of motion of the web to be formed. For the sake of clarity, the apparatus is shown in a diagrammatic and simplified form. Features essential to the solution of the invention are the channel system 9 arranged above the former 2 in the circulation of conveying air and the channels provided in the suction box 8. The channels 9 above the former 2 are divided by partitions 16 into flow channels 17, a suitable number of which is two or more, preferably e.g. four. The flow channels 17 start with equal cross-sectional areas from a regulating element 18 placed in the circulation air channel 15 and extend with a curvature in the transverse direction of the forming wire 7 while at the same time expanding towards the upper part of the former 2 above the screen drums 3 so that, as they join the upper part of former, each flow channel 17 has an equal cross-sectional area and each flow channel 17 is equally wide in the transverse direction of the forming wire 7 and their total width covers substantially the entire transverse width of the forming wire.

The suction box 8 is correspondingly divided by partitions 10 into channels 11, the number of which is substantially the same as the number of channels 17 in channel system 9. The cross-sectional area of channels 11 and their width in the transverse direction of the forming wire at the upper surface of the suction box correspond to the corresponding dimensions of channels 17 at the upper edge of the drum part of the former 2. Channels 11 are bent to guide the circulating conveying air to the side of the suction box 8 and the channels become smoothly narrower so that the channels 11 have substantially the same cross-section in their outlet openings in the lateral surface of the suction box 8. In addition, the outlet openings are provided with a regulating element 20 corresponding to regulating element 18, including regulating plates 21. By turning these regulating plates 21, the free cross-sectional area of each one of the channels 11 can be separately adjusted independently of the other channels either during operation or when operation has been stopped.

Attached to the lateral surface of the suction box 8 is a exhaust duct 12 for discharge of circulated conveying air, the mouth of which duct covers the outlet openings of all channels 11. The exhaust duct 12 leads to a fan 13, on the delivery side of which is further a circulation air channel 15 with an exhaust air duct 14 branching out from it. The circulation air channel 15 coming from the fan 13 continues in a curved form from the side of the former 2 towards the channel system 9 above the former and joins the channel system 9 substantially in the region of the regulating element 18, completely covering the beginnings, i.e. mouths of the channels 17. One of the reasons why an exhaust air duct 14 is necessary is that more air enters into the fibre drying circulation through the inlet openings 5 and 6 in the ends of the screen drums 3.

The regulating element 18 has e.g. regulating plates 19 at the beginning of each channel 17, and the free cross-sectional area of the mouth of each channel 17 can be adjusted separately and independently of the other channels by turning these regulating plates. Via adjustment of the mouth, the flow of circulation air and fibres carried in it to the former can be regulated during operation, i.e. during formation of the web, and thus the regulation makes it possible to achieve a fibre layer thickness as uniform as possible on the forming surface of the forming wire 7.

According to the procedure of the invention, dry formation of the fibre layer takes place e.g. as follows. Let the starting point be the supply of fibre flow via the inlet openings 5 and 6, the fibre flow being fed into the screen drums 3 of the former 2 along with the conveying air. From the screen drums 3, the fibre flow is passed via the through holes in the screen drums onto the forming surface of the moving forming wire 7 to the upper part of the suction box 8. By means of the fan 13, an air circulation is generated in the suction box 8 to suck, i.e. to draw the conveying air flowing through the forming wire 7 through the suction box via channels 11 and regulating element 20, and this air circulation is passed further via the fan 13 mainly into the circulation air channel 15 and into the exhaust air duct 14 as far as necessary.

From the circulation air channel 15, the conveying air containing fibres and to be circulated is passed through the regulating element 18 into the channels 17 in the channel system 9 provided in the upper part of the former 2 in such manner that, before being passed into the channels 17, the circulation air flow is adjusted if necessary to a desired level by means of the regulating device 18 separately for each channel. The channel-specific adjustment is preferably made while the apparatus is running, so that the effect of the adjustment on the fibre layer is seen at once and the adjustment can be corrected if necessary. The adjustment is effected at or near the mouths of the channels 17 by decreasing and increasing the cross-sectional flow area of the mouths of the channels 17 by means of the regulating plates 19. The adjustment can also be made while the plant is standing still. Thus, it is possible to make a preliminary adjustment e.g. after maintenance or other interruption of operation before the apparatus is started again and a final and more accurate adjustment is then made during operation.

It is obvious to the person skilled in the art that the invention is not limited to the embodiment example described above but that it can be varied within the scope of the claims presented below. Thus, the former may be of some other type than a dual-drum drum former as described above. The essential feature is circulation of conveying air and operation-time adjustment of the circulation flow.

It is also obvious to the person skilled in the art that the construction of the apparatus may differ in other ways too from the above description. The placement of the channel systems and the numbers of channels may vary. For example, a solution implemented with two, three or more channels may give an equally good final result as the above-described embodiment implemented with four channels. Thus, the number of channels may quite well be even higher than four. The appropriate number depends, among other things, on the width of the web to be formed. It is likewise obvious that the numbers of channels in the channel system 9 and in the suction box 8 need not necessarily be the same. Thus, for example, the suction box 8 may also contain only two or three channels while the channel system 9 contains e.g. four channels. The suction box may also be implemented completely without said channels.

In addition it is obvious to the person skilled in the art that the circulation may be so controlled that the flow takes place along some other route than directly from the suction box to the upper part of the same former. In this case the circulation may be passed to the upper part of a second former in the apparatus or before the former e.g. to a fibre separator or to some other desired apparatus.

The invention claimed is:

1. An apparatus in dry formation of a fibre layer, said apparatus comprising at least one former or an equivalent distributor unit, a forming wire moving below the former and at least one with adjustable channels equipped suction box below the forming surface of the forming wire and a system of circulation air channels leading from the suction box to the upper side of the same or some other former or an equivalent distributor unit, the circulation air channels having channel system equipped with regulating element and divided into substantially separate channels, characterized in that the number of channels in the suction box is substantially the same as the number of channels in the channel system.

2. An apparatus according to claim 1, wherein the cross-sectional area of channels and their width in the transverse direction of the forming wire at the upper surface of the suction box has been fitted to correspond to the corresponding dimensions of channels at the upper edge of the drum part of the former.

3. An apparatus according to claim 1, wherein the regulating element of the channels of the channel system has been fitted to be adjusted during operation of the apparatus.

4. An apparatus according to claim 1, wherein the channels in the suction box has been fitted to lead in a converging manner into an exhaust duct provided at the side of the suction box and leading to a fan.

5. An apparatus according to claim 1, wherein the cross-sectional areas of channels at the junction between the upper part of the former and the channels are mutually substantially equal, and that the total width of channels covers substantially the entire transverse width of the forming wire at the junction of the upper part of the former.

6. An apparatus for the formation of a fibre layer, the apparatus comprising:

at least one former;

a moving forming wire disposed below the former;

a suction box disposed below a forming surface of the forming wire, the suction box including at least one adjustable lower channel; and at least one circulation air channel leading from the suction box to an upper side of the at least one former, the at least one circulation air channel having a regulating element for regulating air passage to at least one upper channel, wherein the number of upper channels is substantially the same as the number of lower channels, the at least one upper channel being adjustable during operation.

7. An apparatus according to claim 6, wherein the cross-sectional area of channels and their width in the transverse direction of the forming wire at the upper surface of the suction box has been fitted to correspond to the corresponding dimensions of channels at the upper edge of the drum part of the former.

8. An apparatus according to claim 6, wherein the regulating element of the channels of the channel system has been fitted to be adjusted during operation of the apparatus.

9. An apparatus according to claim 6, wherein the channels in the suction box has been fitted to lead in a converging manner into an exhaust duct provided at the side of the suction box and leading to a fan.

10. An apparatus according to claim 6, wherein the upper channel is divided into substantially separate channels, the air passage regulation to the separate channels being adjusted separately.

* * * * *